United States Patent [19]

Flum et al.

[11] Patent Number: 4,724,682

[45] Date of Patent: Feb. 16, 1988

[54] CONTAINER ASSEMBLY FOR CHILLED STORAGE AND DISPENSING OF ARTICLES

[75] Inventors: Paul Flum, Laude; Jerry M. Mynatt, Desoto, both of Mo.

[73] Assignee: Paul Flum Ideas, Inc., St. Louis, Mo.

[21] Appl. No.: 906,754

[22] Filed: Sep. 11, 1986

[51] Int. Cl.[4] ..... F25D 3/02

[52] U.S. Cl. ..... 62/462; 62/371; 62/457; 62/463; 62/458

[58] Field of Search ..... 62/462, 463, 467, 457, 62/458, 459, 371

[56] References Cited

U.S. PATENT DOCUMENTS

| | | | |
|---|---|---|---|
| 161,626 | 4/1875 | Meeks | 62/457 |
| 282,220 | 7/1883 | Pettersson | 62/463 X |
| 282,221 | 7/1883 | Pettersson | 62/463 |
| 307,341 | 10/1884 | Shaw | 62/462 X |
| 415,777 | 11/1889 | Gordon | 62/457 X |
| 950,763 | 3/1910 | Coleman | 62/462 |
| 1,380,190 | 5/1921 | Cohen | 62/462 X |
| 1,404,302 | 1/1922 | Krieter et al. | 62/464 X |
| 2,631,402 | 3/1953 | Lastofka | 62/371 X |

*Primary Examiner*—Lloyd L. King
*Attorney, Agent, or Firm*—Haverstock, Garrett & Roberts

[57] ABSTRACT

A container assembly for storing and displaying chilled products such as bottled or canned soft drink beverages and the like comprising a body member, a floor member positioned adjacent the lower end portion of the body member, a tub member adapted to hold products positioned therein located adjacent the upper end portion of the body member, a drain tank assembly positioned intermediate the floor member and the tub member, and a plurality of bracket members attached to the inner wall surface of the body member, each of the bracket members including a plurality of spaced shoulder surfaces adapted for positioning and supporting the floor member, and/or the tub member, and/or the drain tank assembly. The drain tank assembly includes a spigot mechanism for emptying the waste chilled water received therein, the spigot mechanism being movable between a first position wherein the spigot mechanism is located within the body member and a second position wherein the spigot mechanism is at least partially exposed outside of the body member. A pivotable lid member, preferably made of a clear plastic material, is attached to a portion of the periphery of the tub member to enhance the visibility of the products displayed therein and to facilitate easy access and removal thereof.

22 Claims, 18 Drawing Figures

CONTAINER ASSEMBLY FOR CHILLED STORAGE AND DISPENSING OF ARTICLES

BACKGROUND OF THE INVENTION

This invention relates to a container assembly for chilled storage, display and sale of articles such as bottled or canned soft drink beverages. More particularly, the invention relates to a container assembly that is visually attractive to prospective customers and attractively displays the chilled articles stored therein in a readily accessible manner for easy removal therefrom. The present container comprises separate components which can be easily assembled by one person to form the finished display unit; it requires a minimum of floor space; it is easily and readily movable from one location to another; and it is adapted for easy and simple refilling with articles and ice as well as storage and emptying of waste chilled water from the melted ice.

In the merchandising of single unit articles, such as bottled or canned soft drink and juice type beverages and, particularly, those impulse items which are desired pre-chilled by customers and are normally sold in single units, it is important to have a container for storing and chilling such articles wherein such container is big enough to accommodate a reasonable number of such articles. It is also important that such a container keep the articles in a chilled condition, that such chilled articles be easily accessible to prospective customers, that such a container be mobile, and that such a storage container be sized to economize on required floor space. These are all important features not only because floor space in a merchandising environment is at a premium, but also because such a container would offer great flexibility in the choice of where it may be located since merchandisers know that the strategic location of articles that are for sale can have a great impact on the volume of sales of such articles. Another desirable characteristic of a container for such articles is that it be attractive and that it catch the eye of prospective shoppers and buyers.

This invention not only satisfies the foregoing needs, but it does so in an inexpensive way by providing an assembly comprised of components that can be easily assembled without special tools to produce a ready-to-use three-dimensional container which is easily moved from one point-of-sale location to another and which requires very little floor space.

SUMMARY OF THE INVENTION

The present invention comprises a container assembly for articles to be merchandised wherein the container assembly includes several individual components. In a preferred embodiment, the present assembly includes a cylindrical body container which is preferably formed of two plastic body panels made of a substance that causes the panels to be resilient and biased towards a flat condition. Each body panel contains complementary interlockable channel members extending along the side edges of the body panels which enable the two body panels to be locked together at adjacent side edges to form the body cylinder. The design of the interlockable channel members is such that, when the body panels are in cylindrical form, the resilience of the body panels creates a pressure that retains the channel members tightly locked together. The channel members are also formed with flanges that extend past the side edges, overlying margin portions of the panels. These flanges are stiff enough to resist the resilience of the body panels that would otherwise tend to create a sharp joint along the lines of interlock. The flanges cooperate with the resilient bias or force of the body panels to maintain the curvature of the cylinder in a smooth arc through the interlocking joints of the body panels.

The body panels as well as the channel means for interlocking the same are more fully described in Applicant's co-pending U.S. patent application Ser. No. 708,034, filed Mar. 4, 1985, now U.S. Pat. No. 4,610,363 issued Sept. 9, 1986, which U.S. Patent is likewise assigned to Applicant's assignee, Paul Flum Ideas, Inc. The subject matter disclosed in U.S. Pat. No. 4,610,363 is incorporated herein by reference. Although the construction of the body cylinder as disclosed in the above-noted U.S. Pat. No. 4,610,363 is preferred for all of the reasons noted therein, the present body cylinder may also be formed from any plurality of panels or it may be made of unitary construction without departing from the spirit and scope of the present invention. It is also anticipated that other suitable joinder means for attaching the respective panels may likewise be utilized. In addition, it also recognized that the present body cylinder is not limited to a cylindrical shape but may also be conveniently fashioned into a variety of sizes and configurations, for example, a rectangular, hexagonal, ellipsoidal or other configuration without impairing the teachings and practice of the present invention.

The inner side walls of the present body cylinder have a plurality of hanger brackets joined or fastened thereto, conveniently four in number and equally spaced, which brackets include a plurality of spaced shoulder surfaces adapted for positioning and supporting a plurality of internal members. The internal members positioned and supported by the hanger brackets include a floor member having floor support members associated therewith, a drain tank assembly including a drain tank platform member and a floor therefor, and an insulation tub assembly including an insulation tub and support ring member.

The lowest positioned internal member within the assembled container is a floor assembly which includes three components, namely, a floor member and two support plate members. The floor support plate members can be made from a wide variety of known materials such as wood, presswood, plywood, particle board or plastic and are fixedly attached by conventional fastening means such as nails, staples, screws or other suitable means in a form of a cross to the lower portion of the floor member to add strength and stability thereto. The outer ends of each floor support member are provided with a notch sized to accommodate the lowest shoulder surface associated with each hanger bracket. The floor member may likewise be formed of wood, presswood, plywood, particle board, or other suitable materials and its size and shape are specifically dimensioned depending upon the size and shape of the body container to be used. In the case of a cylindrical body container, the lower floor member is circular and is sized to fit within the lowest recessed area and rest upon the lowest shoulder surface associated with each hanger bracket when positioned and inserted into the lower portion of the body container.

Above the floor assembly there is next positioned a drain tank and supporting assembly comprising a drain tank floor member made of masonite, presswood, plywood, particle board or other suitable material suitably sized to rest upon the second or intermediate shoulder surface associated with each hanger bracket. Resting upon the drain tank floor member and also supported by the intermediate shoulder surface of the respective hanger brackets is a drain tank platform member. The platform member is preferably formed for use with a cylindrical body container having a substantially round base for approximately 270° of its circumference, the platform member being substantially the same size as the drain tank floor member. In the remaining 90° of its circumference, the platform member is open and includes no obstructions. A rectangular drain tank receiving and holding section is defined within the platform member by upstanding wall segments, such rectangular tank receiving and holding section being optionally ribbed. The entire drain tank platform member may be conveniently vacuum formed from plastic, although various other acceptable methods and materials of construction are available and could equally be employed to construct the drain tank platform member.

Located upon the drain tank platform member and supported thereby is a plastic drain tank of substantial liquid capacity which is provided with a drain spigot near the lower end of one of its end walls. The drain tank is also provided with a fluid input nipple and an air vent nipple, both located adjacent the upper edge of an end wall, and such tank may conveniently be provided with a handle on either its top or end portion for conveniently removing and replacing said tank. As an added convenience, the spigot assembly of the drain tank can be provided with a pull tab which will project through an opening in the side of the body container and provide a convenient means for pulling the tank forward to expose the spigot for emptying the same and returning the tank to its interior stored position when drainage is completed. Both the fluid input nipple and the air vent nipple are connected by means of plastic tubing respectively to the drain hole in the upper chilling tub and to the upper interior pheriphery of the body container above the level of the bottom wall of the chilling tub.

Above the drain tank assembly just described there are positioned in approximately the upper 40 to 50 percent of the body container the upper chilling tub with its hinged lid member and associated insulation tub and supporting ring. The support ring can be made of masonite, presswood, plywood or other suitable materials and is positioned on and supported by the topmost shoulder surface of the hanger brackets mounted on the interior of the body cylinder. Resting on the support ring member is an insulation tub preferably of a styrofoam material, although other suitable insulation type materials may also be used, designed to surround and insulate the bottom and sides of the upper chilling tub. The upper chilling tub is preferably made of a lightweight plastic material and takes the form of a cylindrical tub having a substantially flat bottom wall. The chilling tub is shaped and sized to fit within the insulation tub and includes a projecting and downturned rim terminating the top edge of the annular sidewall associated therewith. The projecting downturned rim fits over the top of the insulation tub and the top edge of the body container in such a manner that the entire upper chilling tub is supported by the top edge of the body container. It is recognized that the individual components of the insulation tub assembly may also be fashioned into a variety of sizes and shapes other than a cylindrical shape so as to conform with the shape and size of the body container.

The upper chilling tub is suitably provided with one flat segment of its periphery to accommodate a hinge means for attaching a lid member to the rim of the upper chilling tub. Resting upon and hingedly attached to the projecting and downturned rim associated with the upper chilling tub is a see-through lid member which is designed to rest upon the inner portion of said rim. This see-through lid may be molded or vacuum formed from clear plastic. The lid member is suitably provided with generally triangularly shaped bosses, two of which bosses are located on each opposite side of the hinge means and a third boss is located on the circumference of the lid member opposite the mid point of the hinge means. The two bosses located adjacent the hinge means serve to maintain the lid member in an open and substantially erect position when fully raised to such position and the third boss serves as a convenient handle means for grasping and opening the lid.

The present container assembly can readily be assembled by one person from its individual constituent parts. The body side panels are provided with interlocking channels which are sufficiently strong to hold the panel edges together and maintain the cylindrical or other shape of the body container. Alternatively, these body panels can be further affirmatively fastened at such channels by positive fastening means such as rivets, bolts or the like. The clear plastic lid of the upper chilling tub serves to close the chilling tub, provides visibility of its contents and provides ready access to the articles therein by customers. Signage and other indicia may likewise be included on the exterior of the body container to enhance its appearance and/or to promote the sale of the chilled items stored therein.

It is therefore a principal object of the present invention to provide a container assembly for conveniently and attractively merchandising chilled articles.

Another object is to provide a container assembly for chilled articles that is suitable for resting on a floor surface such as the aisle of a retail store.

Another object is to provide a container assembly for chilled articles that allows high visibility of the articles stored therein and promotes ready access to such articles by customers.

Another object is to provide a container assembly for chilled articles that may be constructed of inexpensive materials and yet is rugged and will withstand the abuse of a central display in a high traffic shopping area.

Another object is to provide a container assembly for chilled articles that can be easily and readily drained of melted ice water without emptying or dismantling the entire container assembly and the provisions for which do not interfere with customer traffic.

Another object is to provide a container assembly for chilled articles which can be easily assembled without special tools.

Another object is to provide a container assembly for chilled articles which includes a specially designed platform member for receiving and holding a drain tank, the platform member enabling the tank drain spigot to be easily moved to a position outside of the container assembly side wall for drainage and to be easily returned to its interior stored location.

Another object is to provide a container assembly for chilled articles having a plurality of internal hanger bracket members constructed so as to support and suspend internal components at a plurality of levels therewithin.

A still further object of the present invention is to provide a container assembly for chilled articles which can be readily relocated from one point-of-sale location to another without emptying the same.

Other objects and advantages will become apparent from the detailed description, drawings and claims which follow:

DESCRIPTION OF THE PREFERRED EMBODIMENT

For illustrative purposes only, the present container assembly for displaying and merchandising chilled articles is described and disclosed with respect to a cylindrically shaped body container. It is anticipated and recognized that the body container may be fashioned in a variety of sizes and shapes as previously explained and that the internal components of the present container assembly may likewise be correspondingly shaped to conform to the shape of the body container without departing from the teachings and practice of the present invention.

Figure 1:
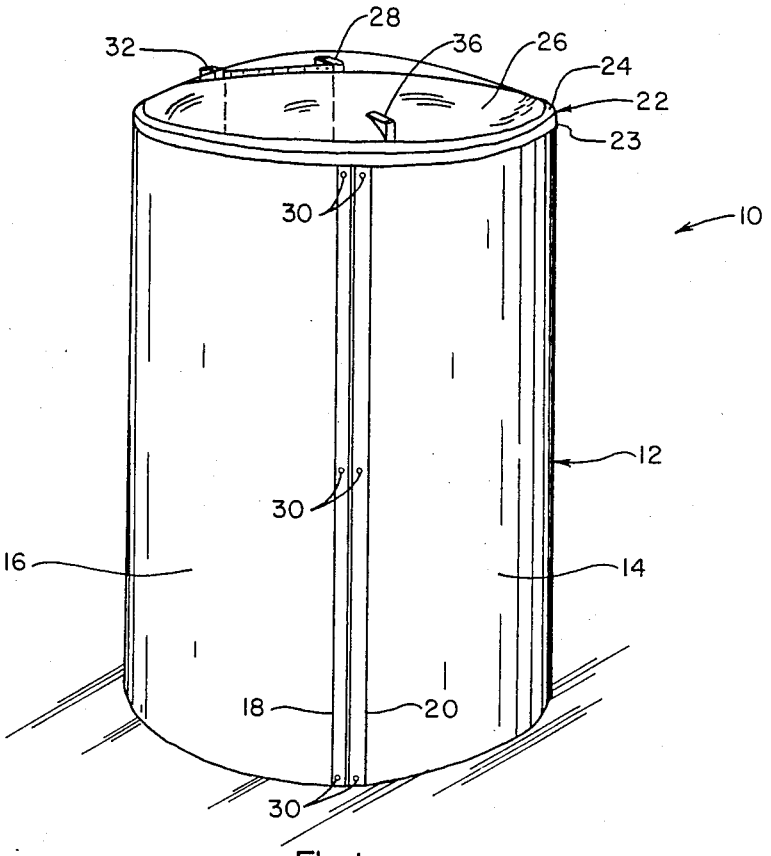
FIG. 1 is a perspective view of a container assembly for chilled storage and display of articles, in assembled form, constructed according to the teachings of the present invention.
Figure 3:
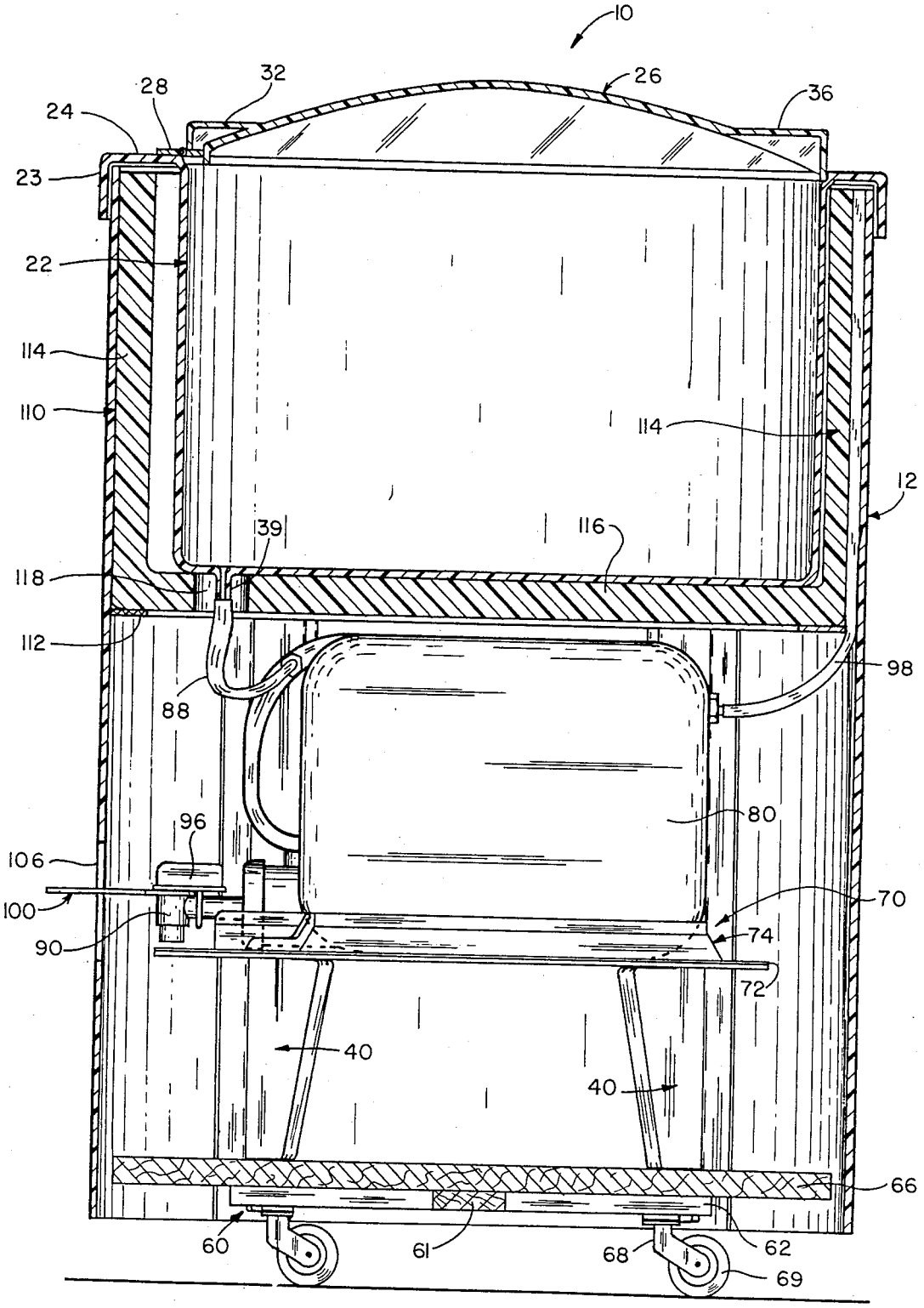
FIG. 3 is a side cross-sectional view of one embodiment of the present container assembly in fully assembled form taken along the line 3—3 of FIG. 6.

Referring to the drawings more particularly by reference numerals wherein like numerals refer to like parts, number 10 in FIGS. 1 and 3 identifies a container assembly constructed according to the teachings of the present invention. The present container assembly 10 comprises a body container 12, a chilling tub 22, a hinged lid member 26, a drain tank assembly 70, an insulation tub assembly 110 and a floor assembly 60. When all of the above components are assembled to form the container assembly 10, as illustrated in FIG. 1, the result is a three dimensional container assembly that can store and maintain chilled a substantial number of chilled articles such as soft drink beverage cans and bottles. The body container 12 is shown as being cylindrical in shape and comprises two body panels 14 and 16. The body panels 14 and 16 and their respective attached channel members including their associated inner flange members (not shown) and outer flange members 18 and 20 are described in detail in Applicant's U.S. Pat. No. 4,610,363 as previously set forth above, which disclosure is incorporated herein by reference. The body panels 14 and 16 are fully disclosed in the above identified U.S. Pat. No. 4,610,363 and therefore will not be described in detail herein.

As described in the above incorporated reference, the body panels 14 and 16 are preferably formed of resilient plastic and incorporate complementary interlocking channel members at their respective side edges. Each body panel 14 and 16 may be conveniently sized to suit the desired needs of the particular display. The complementary interlocking channel members, which extend along the side edges of the body panels 14 and 16 are preferably formed of an extruded plastic of a composition which causes the channel members to be fairly stiff but yet possess some resilience. Each complementary interlocking channel member is formed with a short flange 18 and 20 which lies along a marginal portion of the outer surface of the respective body panel adjacent the edge thereof. Each interlocking channel member also is formed with a longer inner flange (not shown) which lies along a spaced apart marginal portion of the inner surface of the respective body panel adjacent the edge thereof. The side edges of each body panel 14 and 16 are positioned within the recess between the shorter outer flange 18 or 20 and the longer inner flange. The surfaces of the body panel margins and the respective flanges are bonded together by a suitable cement or by any other suitable fastening means. For added strength and stability, the outer and inner flanges and the marginal edge portions of each body panel 14 and 16 may preferably be fixed by means of rivets, bolts or like fastening means 30. It is also recognized that the body panels 14 and 16 may be suitably joined by other means including conventional fastening means, or the body cylinder 12 may be formed as a one piece unit without departing from the scope of the present invention. Also, as previously mentioned, it is recognized that other shapes and sizes of the body panels 14 and 16 as well as the total number used may vary and, in addition, other suitable joinder means for joining the body panels together may likewise be utilized.

A plurality of hanger brackets 40 (FIGS. 4 and 5), usually four, are situated within the inner wall of body cylinder 12, two of which are shown installed in FIG. 3. The hanger brackets 40 are positioned and located so as to be substantially equally spaced about the inner wall of the body cylinder 12, and hence two are fixed or attached to the inner surface of each body panel 14 and 16. The hanger brackets 40 may be easily fixed or attached to the body panels 14 and 16 by means of fasteners such as rivets or the like, by means of heat welding or preferably by cementing them thereto. Other suitable fastening means may likewise be utilized.

Figure 4:
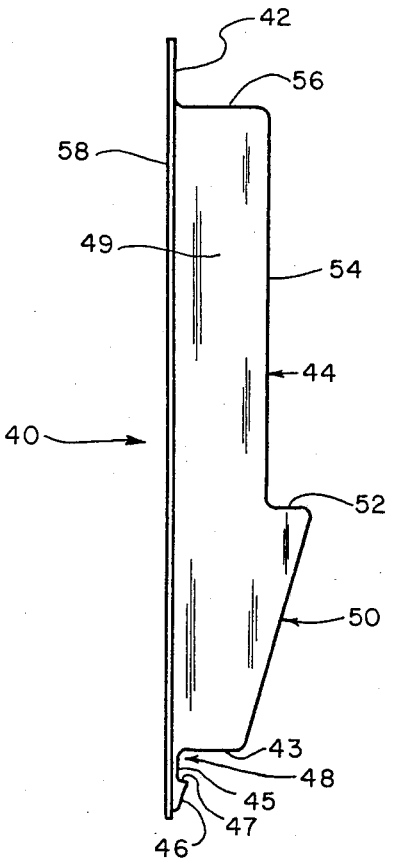
FIG. 4 is a side elevation view of one of the hanger brackets used in the present container assembly.
Figure 5:
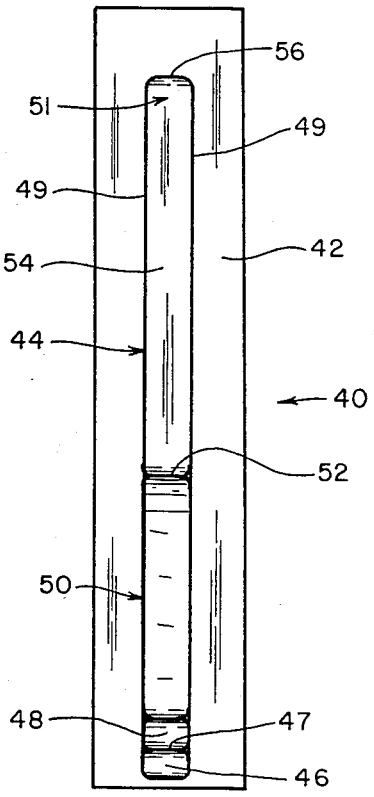
FIG. 5 is a front elevation view of the hanger bracket of FIG. 4.

The design of each hanger bracket 40 is shown in detail in FIGS. 4 and 5. Each hanger bracket 40 is of a complex shape which is generally produced by vacuum forming plastic sheet material. The parts thereof comprise a substantially flat backing member 42 and a projection member 44 formed along approximately the center line of the backing member 42. The projection member 44 includes two spaced substantially parallel projecting side walls 49 and a forward wall 51 defining at least three shoulder surfaces 47, 52 and 56 and a recessed area 48. The lowest shoulder 47 is formed as the upper surface of projection 46 and is substantially horizontal as best shown in FIG. 4. A recessed area 48 is defined by the shoulder 47, the rear wall 45 associated with the recessed area 48, and the bottom wall 43 associated with the slanted or angularly related portion 50 of the the forward bracket wall 51. The slanted portion 50 of wall 51 is also terminated at its upper end by a second horizontal shoulder surface 52 which surface 52, in turn, mates with the vertically extending straight portion 54 of the wall 51 as shown in FIG. 4. The vertically extending portion 54 of wall 51 is similarly terminated at its upper end by the third or upper horizontal shoulder surface 56. Attachment of the brackets 40 to the inner wall of body cylinder 12 is preferably accomplished by cementing the respective back surfaces 58 of the backing members 42 to the inner wall surface of each of the body panels 14 and 16. The specific shape and design of the hanger brackets 40 and, in particular, the location and placement of the shoulder surfaces 47, 52 and 56 are important because it is these surfaces which serve to locate and support the interior components of the container assembly 10 as will be hereinafter described.

Figure 6:
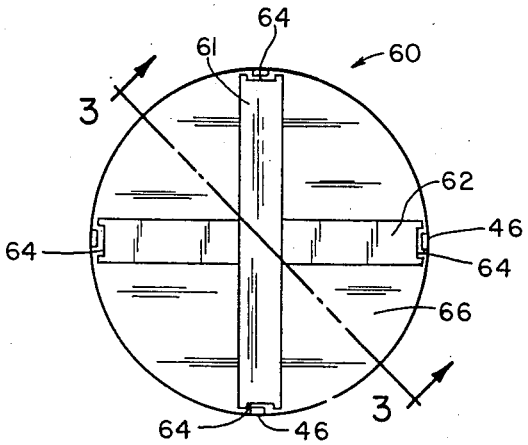
FIG. 6 is a bottom elevation view of the floor assembly.
Figure 13:
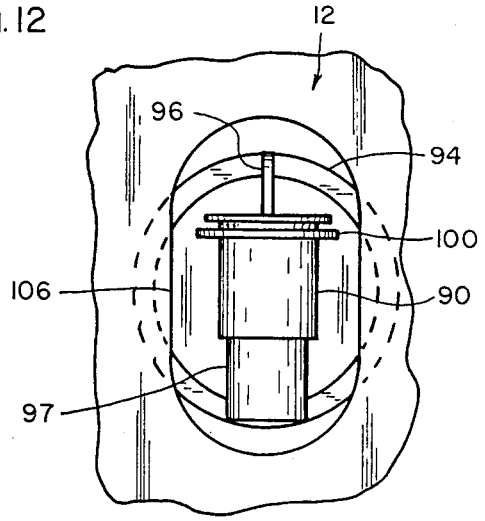
FIG. 13 is an enlarged fragmentary front elevation view of the drain tank spigot.
Figure 15:
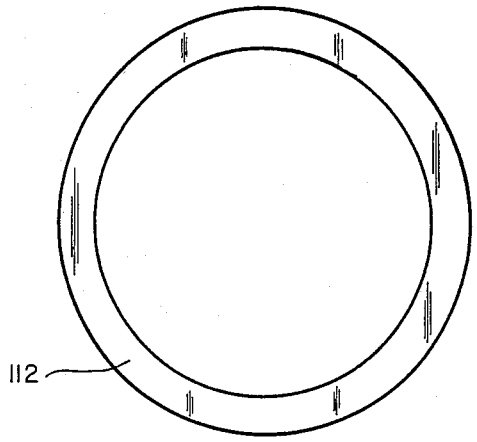
FIG. 15 is a top plan view of the insulation tub support ring member.
Figure 16:
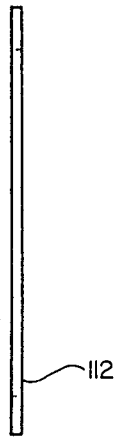
FIG. 16 is a side edge view of the insulation tub support ring member of FIG. 15.
Figure 7:
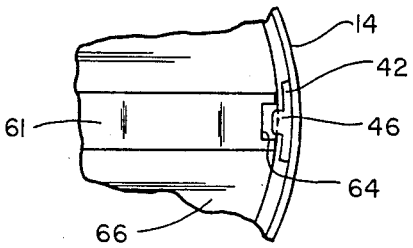
FIG. 7 is an enlarged fragmentary bottom view showing the floor member and one of the floor support members fitted into a corresponding hanger bracket.
Figure 8:
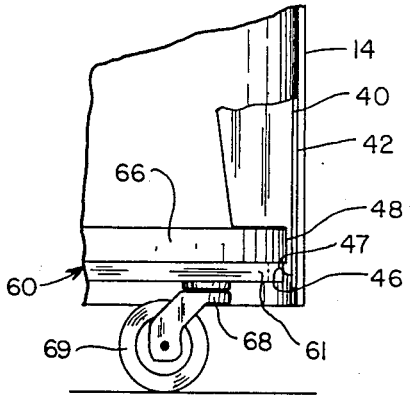
FIG. 8 is an enlarged fragmentary side view showing the floor member and one of the floor support members fitted into a corresponding hanger bracket having a caster and wheel assembly attached to the floor support member.
Figure 17:
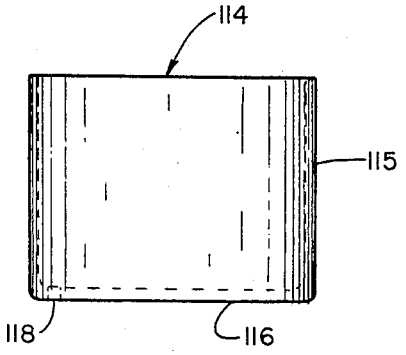
FIG. 17 is a side elevation view of the insulation tub.

The location of the floor assembly 60 at the lower end of the body cylinder 12 is best shown in FIG. 3. FIG. 6 illustrates the floor assembly 60 comprising a pair of floor support members 61 and 62 and a floor member 66. The floor member 66 is generally circular in shape to conform to the shape of the cylindrical body container 12 and can be made from any well known materials such as wood, particle board, masonite or plastic. The floor support members 61 and 62 may likewise be made from similar types of material and may be provided with complementary upper and lower notches (not shown) for joining the two members at their crossover or intersection point (FIG. 6). Alternatively, floor support member 62 may comprise two pieces abutting the center portion of support member 61 as shown in FIG. 6. Both floor support members 61 and 62 are fixed or attached to the bottom surface of floor member 66 by any known means such as nails, screws, staples, rivets, or cement. Other suitable fastening means may likewise be uitlized. The floor support members 61 and 62 are also provided with notches 64 in either end thereof for accommodating the projections 46 located at the lower end of each respective hanger bracket 40 as best shown in FIG. 7. The manner in which floor assembly 60 is fitted into the recessed area 48 and supported by the projection 46 and the shoulder 47 of each hanger bracket 40 is shown in FIG. 8. The floor member 66 is dimensioned so as to be slightly oversized as compared to the area defined between the respective projections 46 and therefore the floor member 66 must be forced past the projections 46 and snapped or pressure fitted into the recessed areas 48. Once positioned within the recessed areas 48, the floor member 66 rests upon the respective shoulder surfaces 47 and is restricted from movement in one direction by the surface 47 and in the opposite direction by the wall 43. This arrangement secures the floor assembly 60 within the body cylinder 12 and prevents its release therefrom regardless of the orientation of the cylinder 12. FIG. 8 as well as FIG. 3 also illustrates the optional but preferred caster 68 carrying wheel 69 mounted on the lower surface of the respective floor support members 61 and 62. Such casters 68 and wheels 69 confer easy mobility to the container assembly 10 without the need of unloading or draining the chilling tub 22 before moving the entire assembly from one location to another.

Figure 9:
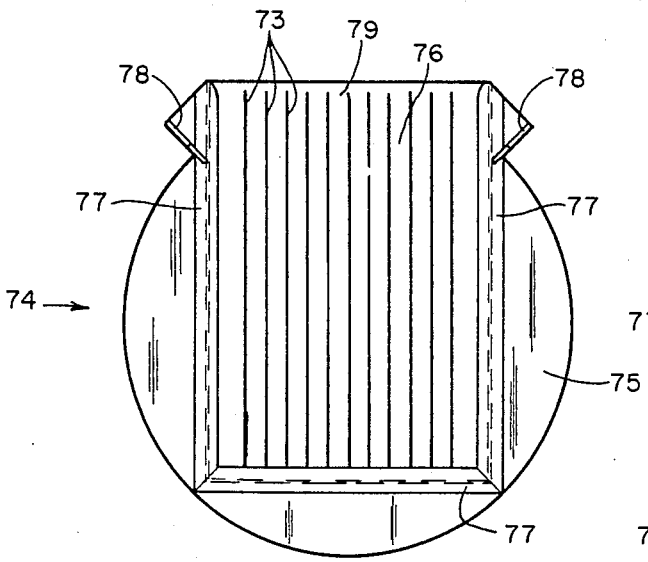
FIG. 9 is a top plan view of the tank platform member used in the present container assembly.
Figure 10:
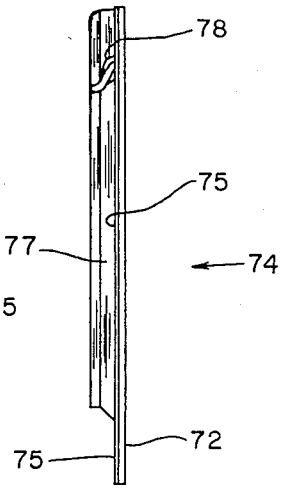
FIG. 10 is a side elevation view of the tank platform member of FIG. 9 showing the tank floor member 72 attached thereto.

The drain tank assembly 70 shown in FIGS. 3 and 9–14 is comprised of a floor member 72, a platform member 74 and a drain tank 80 with associated spigot 90 and drain and vent tubes 88 and 98. The floor member 72, shown in FIG. 3, is again circular in shape to conform to the cylindrical shape of the body container 12 and can be conveniently made and sized from masonite or other suitable materials so as to rest upon the intermediate shoulder surface 52 of each respective hanger bracket 40. The purpose of the floor member 72 is to support the drain tank 80 and provide stiffness to the drain tank platform member 74. Platform member 74, shown in detail in FIGS. 9 and 10, is preferably made of vacuum formed plastic sheet material having a substantially circular base section 75, a preferably ribbed rectangular tank receiving and holding section 76, and upstanding wall segments 77 and 78. Wall segments 77 define and form three sides of the rectangularly shaped tank holding section 76. The ribs 73 serve to accommodate and facilitate sliding movement of the drain tank 80 thereacross when the drain tank 80 is moved to and from its interior stored position as will be hereinafter explained. About one quarter of the circumference of the substantially circular platform member 74 is extended as shown in FIGS. 9 and 10 to from the lip portion 79 as an extension of the rectangular tank holding section 76. Wall segments 78 (FIG. 9) are angularly related to the wall segments 77 and serve to position and locate the platform member 74 between two adjacent hanger brackets 40 and to preserve its orientation. If desired, the platform 74 may be optionally cemented or otherwise attached to the floor member 72, although this is not neccessary.

Figure 11:
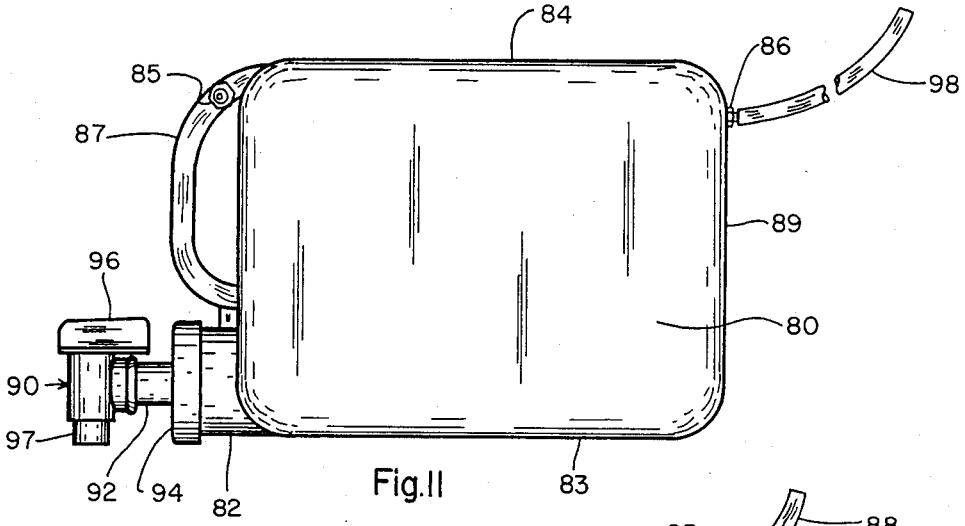
FIG. 11 is a side elevation view of the drain tank.
Figure 12:
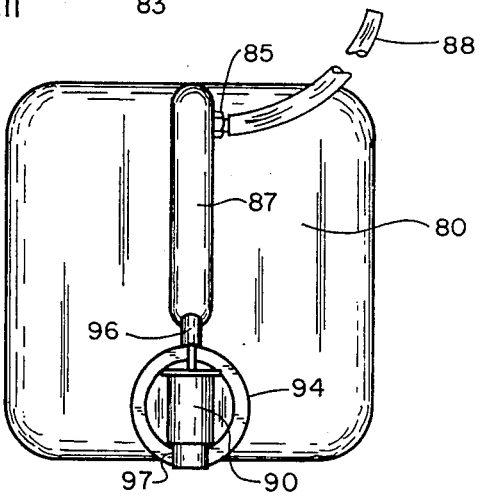
FIG. 12 is a front elevation view of the drain tank of FIG. 11.

Located above and resting on the platform member 74 is the drain tank 80 as shown in FIG. 3. Drain tank 80 is shown in detail in FIGS. 11 and 12 and comprises a plastic type container for liquids having an outlet 82 located adjacent the bottom wall 83 and an inlet nipple 85 and vent nipple 86 located in the upper portion thereof adjacent the top wall 84. If desired, the drain tank 80 may be provided with a handle 87 as shown in FIGS. 11 and 12 for lifting and carrying same. If so provided, the inlet nipple 85 can conveniently be located on the handle 87 which is hollow and communicates with the interior of the tank 80. The vent nipple 86 is conveniently located in the upper portion of the tank back wall 89 and serves to vent air from the tank 80 as it fills with liquid. The outlet 82 carries a spigot 90 connected thereto by pipe 92 and cap 94 as shown in FIGS. 11 and 12. The spigot 90 comprises a valved drain pipe 97 with operating handle 96. The spigot 90 serves to drain or empty the drain tank 80 at intervals as desired to maintain its capacity to accept liquid from the melting ice in the upper chilling tub 22. The drain tank 80 can be of any desired capacity so long as it conforms to and can be accommodated by the size and shape of the body container 12 and the platform member 74, a convenient capacity being about five gallons.

To provide for ease of emptying the drain tank 80 without having to unload or move the upper chilling tub 22, there is provided an aperture 106 in the body container 12 sized to allow the spigot 90 to pass therethrough to the outside of the body container and a pull means such as pull tab 100 to move the drain tank 80 and spigot 90 to a position for emptying the drain tank. This requires that at least the drain pipe 97 and operating handle 96 be moved to the exterior of the body cylinder 12. The flat lip portion 79 and the one open side of the tank platform member 74 enables one to move the drain tank 80 into such a position so that the spigot 90 is positioned on the outside of the body container 12. This arrangement allows the spigot to be hidden from view when the assembly 10 is being used and enhances the attractiveness of the display. This also avoids interference with customers and accidental drainage of the tank 80.

Figure 14:
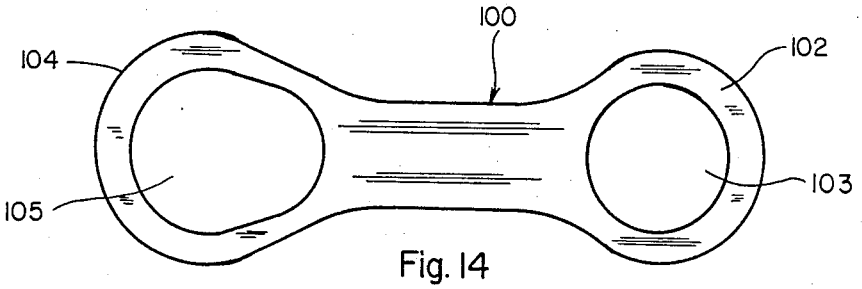
FIG. 14 is a top plan view of the drain tank pull tab member.

Pull tab 100 provides an easy means to move or slide the drain tank 80 forward by pulling on the spigot 90 to expose the same for drainage and to return the drain tank and spigot to its original stored interior position after drainage. Pull tab 100, shown in FIG. 14, is a flat piece of plastic or other material having a ring portion 102 at one end defining an opening 103 and a flattened ring portion 104 at the opposite end defining a somewhat ellipsoidal opening 105. This latter ellipsoidal opening 105 can be fitted over the spigot operating handle 96 to provide a means for moving or sliding the drain tank 80 forward and backward when engaging a finger in the round opening 103 at the opposite free end of the pull tab 100. The pull tab 100, though not essential, provides added ease in emptying the drain tank 80. In this regard, the drain tank 80 should be positioned within the body container 12 such that when exposed for drainage, the spigot 90 is located high enough above the floor or other support surface that a bucket or other receiving means may be easily positioned underneath the same to receive the liquid from the melted ice. For reasons of appearance and avoiding interference with customers, the opening 106 for draining the spigot 90 to the outside of the body cylinder 12 is conveniently located at the rear of the container assembly 10 as shown in FIG. 3, although such opening 106 can be positioned at any desired location around the body container 12.

Figure 18:
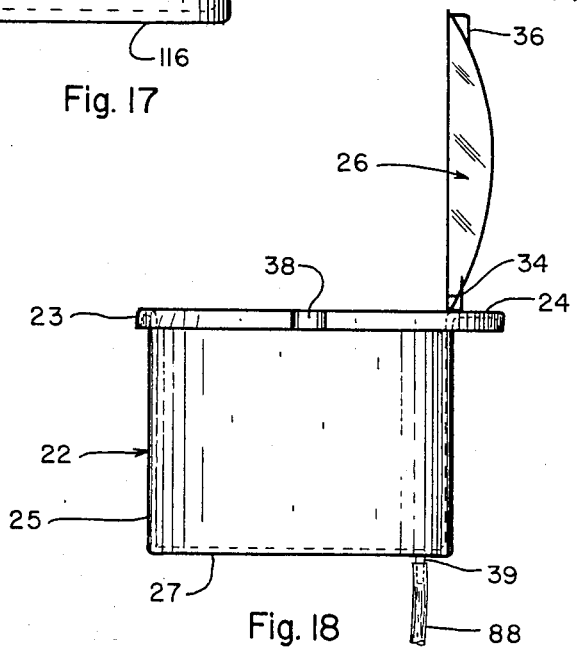
FIG. 18 is a side elevation view of the upper chilling tub with the lid member in its open position showing the drain hole nipple and drain tube attached thereto.

Referring to FIGS. 3 and 15–17, the insulation tub assembly 110 includes the insulation tub 114 and the support ring member 112. The support ring member 112 (FIGS. 15 and 16) is preferably made from masonite or a similar type material and is sized and dimensioned so as to rest upon the upper shoulder surface 56 of the hanger brackets 40 and serves to support the insulation tub 114. Insulation tub 114 is preferably made of styrofoam having an annular sidewall 115 and bottom wall 116 (FIG. 17) and serves to insulate the upper chilling tub 22 so as to keep the articles placed therein cold for as long as possible. The bottom wall 116 of the insulation tub 114 is provided with an aperture 118 to accommodate a drain and nipple 39 associated with the bottom portion of the chilling tub 22 (FIG. 18).

As shown in FIG. 3, the upper chilling tub 22 occupies approximately the upper 40 percent of the entire container assembly 10. The chilling tub 22, shown in detail in FIG. 18, is preferably a one-piece vacuum formed or molded plastic tub having an annular sidewall 25, a bottom wall 27, a top rim portion 24 and an annular downturned edge 23. As formed, the chilling tub 22 is provided with a drain hole and nipple 39 located in the bottom wall 27 thereof, which nipple 39 is adapted to accept a drain tube 88 for conducting the liquid from the melting ice to the drain tank 80. Vent tube 98 from the upper portion of drain tank 80 is normally located by suitable fastening means such as by taping along the inner wall of the body container 12 and terminates adjacent the upper edge thereof. Both the drain tube 88 and the vent tube 98 comprise flexible plastic (polyethylene) tubing. Rubber or other flexible tubing may likewise be used if desired. Edge 23 is conveniently provided with handle members 38 (FIGS. 2 and 18) for use in lifting and removing the chilling tub 22 from the container assembly 10. The handle members 38 can be conveniently integrally formed into the downturned edge 23. As shown in FIG. 3, the chilling tub 22 is shaped and dimensioned so as to fit within the insulation tub 110 and is suspended therein from the top edge of the body cylinder 12 by the rim portion 24. The chilling tub 22 is secured in such position by the annular downturned edge 23. It is also anticipated that the chilling tub 22 may likewise be supported by the supporting member 112 or by the plurality of upper shoulder surfaces 56 associated with the brackets 40.

Figure 2:
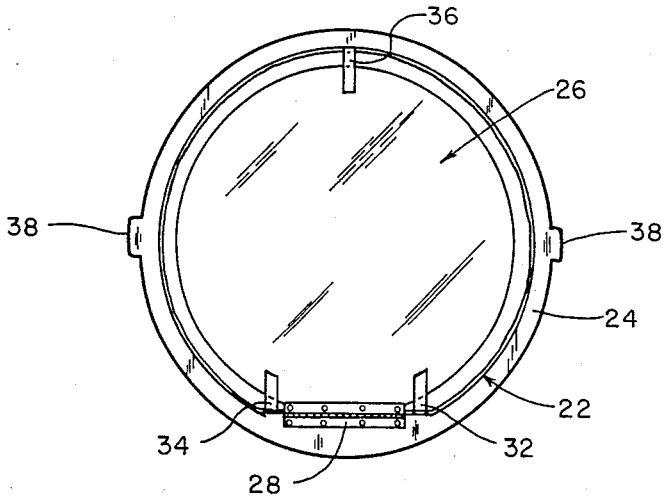
FIG. 2 is a top plan view of the container assembly of FIG. 1 illustrating the lid member, hinge means and top rim member.

Completing the container assembly 10 is the pivotable lid member 26 (FIG. 2) which is preferably made of a clear plastic material to enhance the visibility of the articles displayed therein. The lid member 26 is hingedly attached to the top rim portion 24 of the chilling tub 22 and includes a straight flat segment along a portion of the periphery thereof which facilitates attachment of the hinge member 28 thereto by suitable means as shown in FIG. 2. The lid 26 is formed with a domed center and likewise includes three projecting bosses 32, 34, and 36 (FIG. 2). Bosses 32 and 34 serve as stop means to maintain the lid 26 in an erect position when moved to its open position as shown in FIG. 18, while boss 36 serves as a handle for grasping and lifting the lid member 26 to its open position. The lid 26 made of clear plastic offers an attractive appearance and renders the articles in the container assembly 10 readily visible and accessible to customers.

The various components which have now been described are easily assembled by one person requiring no special tools and is just as easily disassembled, if desired. In use, the chilling tub 22, which can accommodate as many as 75 to 80 beverage cans along with cracked or cubed ice for chilling the same, is filled with the articles for sale and ice for chilling same and then rolled by means of the optional casters 68 and wheels 69 to the desired store location. As the original ice charged to the chilling tub melts, the water is drained to the drain tank 80 and more ice can be added. At selected relatively long time intervals the drain tank 80 can be emptied by pulling the spigot 90 to the outside of the body container 12 and draining the contents of the drain tank to any convenient container. Thus, the container assembly 10 can be refilled repeatedly when its contents are depleted and its location changed as desired without the need of emptying the chilling tub or disassembling any of the unit's components.

Although the present container assembly 10 has been described in connection with the chilling, storage, and display of soft drink type beverages, it can likewise be used for chilling, storing and displaying other articles of merchandise such as fruit juices, milk, beer and the like. Also, color and artistic designs may be easily incorporated on the body container 12 for enhancing the beauty and appearance of the overall assembly and/or for promoting and advertising the particular chilled articles displayed therein. In addition, as previously mentioned, it is also recognized that the body container and all of the internal components of the present device may be conveniently fashioned into a variety of sizes and configurations other than circular or cylindrical without impairing the teachings and practice of the present construction. The simplicity, durability, flexibility and versatility of the present container assembly greatly increases its usefulness and effectiveness for encouraging and promoting point-of-purchase sales.

Thus there has been shown and described a novel container assembly for use in displaying and merchandising chilled articles, which container assembly fulfills all of the objects and advantages sought therefor. Many changes, modifications, variations and other uses and applications of the present container assembly will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A container assembly adaptable for use with cooling means for storing and displaying chilled products comprising a body member, said body member including wall means having inner and outer surfaces and opposed end portions, floor means positioned adjacent one end portion of said body member, a tub member adapted to hold products positioned therein, a drain tank assembly positioned intermediate said floor means and said tub member, and support means associated with said body member for locating and supporting said floor means, said drain tank assembly and said tub member at spaced locations within said body member, said support means including a plurality of bracket members attached to the inner wall surface of said body member, each of said bracket members including at least three spaced apart shoulder surfaces, one of said shoulder surfaces associated with each of said plurality of bracket members being adapted to support said floor means, another of said shoulder surfaces associated with each of said plurality of bracket members being adapted to support said drain tank assembly, and the other of said shoulder surfaces associated with each of said plurality of bracket members being adapted to support said tub member.

2. The container assembly defined in claim 1 including a lid member pivotally attached to said tub member.

3. The container assembly defined in claim 1 wherein said tub member includes drain means.

4. The container assembly defined in claim 3 including means for connecting said drain tank assembly to the drain means associated with said tub member.

5. The container assembly defined in claim 4 wherein said drain tank assembly includes spigot means for emptying same.

6. The container assembly defined in claim 5 including means for moving said spigot means from a first position wherein said spigot means is located within said body member to a second position wherein said spigot means is at least partially exposed beyond the periphery of the outer wall surface of said body member.

7. The container assembly defined in claim 1 wherein said body member is cylindrical in shape.

8. The container assembly defined in claim 1 wherein said body member includes a plurality of panel members.

9. The container assembly defined in claim 1 wherein said floor means includes wheel means.

10. The container assembly defined in claim 1 wherein each of said bracket members includes means for restricting movement of said floor means when said floor means is supported by one of said shoulder surfaces associated with each of said plurality of bracket members.

11. A container assembly adaptable for use with cooling means for storing and displaying chilled products comprising a body member, said body member including opposed top and bottom end portions and wall means having inner and outer surfaces, floor means positioned adjacent one end portion of said body member, a tub member adapted to hold products positioned therein, a drain tank assembly positioned intermediate said floor means and said tub member, and support means for locating and supporting said floor means and said tub member at spaced locations within said body member, said support means including a plurality of bracket members attached to the inner wall surface of said body member, each of said bracket members including first and second spaced apart shoulder surfaces, said plurality of first shoulder surfaces being adaptable to support said floor means, said plurality of second shoulder surfaces being adapted to support said tub member.

12. The container assembly defined in claim 11 including insulation means surrounding the outer wall surface of said tub member.

13. The container assembly defined in claim 12 wherein each of said plurality of second shoulder surfaces are adapted to support said insulation means.

14. The container assembly defined in claim 11 including a lid member pivotally attached to said tub member.

15. The container assembly defined in claim 14 wherein said lid member includes means for maintaining an upright and open position providing access to the interior of said tub member.

16. The container assembly defined in claim 11 wherein said drain tank assembly includes vent means.

17. The container assembly defined in claim 11 wherein said drain tank assembly includes means for emptying same.

18. In a container assembly adaptable for use with cooling means for storing and displaying chilled products including a body member having a floor member, a drain tank assembly, and a tub assembly positioned and located at spaced intervals within said body member, said body member including wall means having inner and outer surfaces, the improvement comprising a plurality of bracket members attached to the inner wall surface of said body member, each of said bracket members including an elongated base portion and a projection portion extending therefrom, said projection portion defining at least three spaced apart shoulder surfaces, said first, second and third shoulder surfaces being arranged and dimensioned such that said plurality of first shoulder surfaces support said floor member, said plurality of second shoulder surfaces support said drain tank assembly, and said plurality of third shoulder surfaces support said tub assembly.

19. A container assembly adaptable for use with cooling means for storing and displaying chilled products comprising a body member having floor means associated therewith, said body member including top and bottom portions and wall means having inner and outer surfaces, a drain tank assembly, a tub member adapted to hold products positioned therein, and support means for locating and supporting said drain tank assembly and said tub member at spaced locations above said floor means and within said body member, said support means for supporting said tub member including means associated with said tub member for cooperatively engaging the top portion of said body member, said support means for supporting said drain tank assembly including a plurality of bracket means attached to the inner wall surface of said body member, each of said bracket means including at least one shoulder surface adapted to support drain tank assembly.

20. A container assembly adaptable for use with cooling means for storing and displaying chilled products comprising a body member, said body member including wall means having inner and outer surfaces and opposed top and bottom end portions, floor means positioned adjacent the bottom end portion of said body member, a tub member adapted to hold products positioned therein, said tub member being positioned within said body member and including means for supporting said member adjacent the top end portion of said body member, a drain tank assembly positioned intermediate said floor means and said tub member within said body member, and a plurality of bracket members attached to the inner wall surface of said body member, each of said bracket members including at least one shoulder surface adapted to support said floor means adjacent the bottom end portion of said body member.

21. The container assembly defined in claim 20 wherein each of said plurality of bracket members includes a second shoulder surface spaced from said at least one shoulder surface, said plurality of second shoulder surfaces being adapted to support said drain tank assembly.

22. A container assembly adaptable for use with cooling means for storing and displaying chilled products comprising a body member, said body member including opposed top and bottom end portions and wall means having inner and outer surfaces, floor means positioned adjacent the bottom end portion of said body member, a tub member having inner and outer surfaces adapted to hold products positioned therein, said tub member including means cooperatively engageable with the top end portion of said body member for supporting said member above said floor means, said tub member including insulation means surrounding at least a portion of the outer surface thereof, a drain tank assembly positioned intermediate said floor means and said tub member, and support means for locating and supporting said floor means and said insulation means at spaced locations within said body member, said support means including a plurality of bracket members attached to the inner wall surface of said body member, each of said bracket members including first and second shoulder surfaces, said plurality of first shoulder surfaces being adaptable to support said floor means, said plurality of second shoulder surfaces being adaptable to support the insulation means surrounding said tub member.

* * * * *